US009240659B2

(12) United States Patent
Brooks

(10) Patent No.: US 9,240,659 B2
(45) Date of Patent: Jan. 19, 2016

(54) BI-PIN DONGLE

(71) Applicant: The Sloan Company, Inc., Ventura, CA (US)

(72) Inventor: Brandon Brooks, Ventura, CA (US)

(73) Assignee: THE SLOAN COMPANY, INC., Ventura, CA (US)

( * ) Notice: Subject to any disclaimer, the term of this patent is extended or adjusted under 35 U.S.C. 154(b) by 221 days.

(21) Appl. No.: 13/841,946

(22) Filed: Mar. 15, 2013

(65) Prior Publication Data

US 2013/0303009 A1 Nov. 14, 2013

Related U.S. Application Data

(60) Provisional application No. 61/645,511, filed on May 10, 2012.

(51) Int. Cl.

| | |
|---|---|
| ***F21V 23/06*** | (2006.01) |
| ***H01R 33/94*** | (2006.01) |
| ***H01R 33/08*** | (2006.01) |
| ***F21V 23/00*** | (2015.01) |

(52) U.S. Cl.

CPC ..... *H01R 33/0836* (2013.01); *F21V 23/001* (2013.01); *F21V 23/06* (2013.01); *H01R 33/94* (2013.01); *H01R 33/942* (2013.01)

(58) Field of Classification Search

CPC ..... F21K 9/17; F21K 9/175; H01R 33/0854; H01R 33/06; H01R 33/065; F21V 23/001; F21V 23/06

USPC ..... 362/220, 221, 646, 652–654, 657–659; 439/76.1, 236, 240, 458, 95, 607.46, 439/620.02, 493, 496, 497, 101, 487

See application file for complete search history.

(56) References Cited

U.S. PATENT DOCUMENTS

| | | | | |
|---|---|---|---|---|
| 3,993,386 | A * | 11/1976 | Rowe | 439/236 |
| 4,928,209 | A * | 5/1990 | Rodin | F21V 7/005 362/217.06 |
| 5,257,172 | A * | 10/1993 | Erickson | F21L 14/02 362/457 |
| 5,593,324 | A * | 1/1997 | Ito | H01R 33/46 439/336 |
| 5,616,042 | A * | 4/1997 | Raby, Sr. | F21V 23/06 439/226 |
| 7,604,505 | B2 * | 10/2009 | Zayas | 439/617 |
| 7,845,983 | B2 * | 12/2010 | Kawada et al. | 439/607.46 |
| 8,304,993 | B2 * | 11/2012 | Tzou et al. | 315/51 |
| 8,430,692 | B2 * | 4/2013 | Peng et al. | 439/607.46 |
| 8,500,303 | B2 * | 8/2013 | Osawa | 362/249.03 |

(Continued)

FOREIGN PATENT DOCUMENTS

| | | |
|---|---|---|
| DE | 202011003701 | 6/2011 |
| DE | 202011003701 U1 | 7/2011 |

OTHER PUBLICATIONS

Patent Translate of Description DE202011003701, by EPO and Google, Jul. 7, 2011, Samtleben Invest GmbH, pp. 1-6.*

PCT Notification of the International Search Report and the Written Opinion of the International Searching Authority, Dated Jul. 26, 2013; for International Application No. PCT/US2013/040423.

(Continued)

*Primary Examiner* — Alan Cariaso

(74) *Attorney, Agent, or Firm* — Koppel, Patrick, Heybl & Philpott

(57) ABSTRACT

The invention described herein is directed to different embodiments of a bi-pin dongle that in some embodiments is adapted to be received by a standard lamp holder to provide an electrical signal to a non-conventionally shaped lamp or other electronic device.

29 Claims, 5 Drawing Sheets

(56) References Cited

U.S. PATENT DOCUMENTS

| | | | | |
|---|---|---|---|---|
| 2010/0277918 | A1 | 11/2010 | Chen et al. | |
| 2011/0081806 | A1 | 4/2011 | Lin | |
| 2012/0300445 | A1 * | 11/2012 | Chu et al. | 362/217.13 |

OTHER PUBLICATIONS

International Preliminary Report on Patentability from PCT/US2013/040423, dated Nov. 11, 2014.

* cited by examiner

FIG. 2a
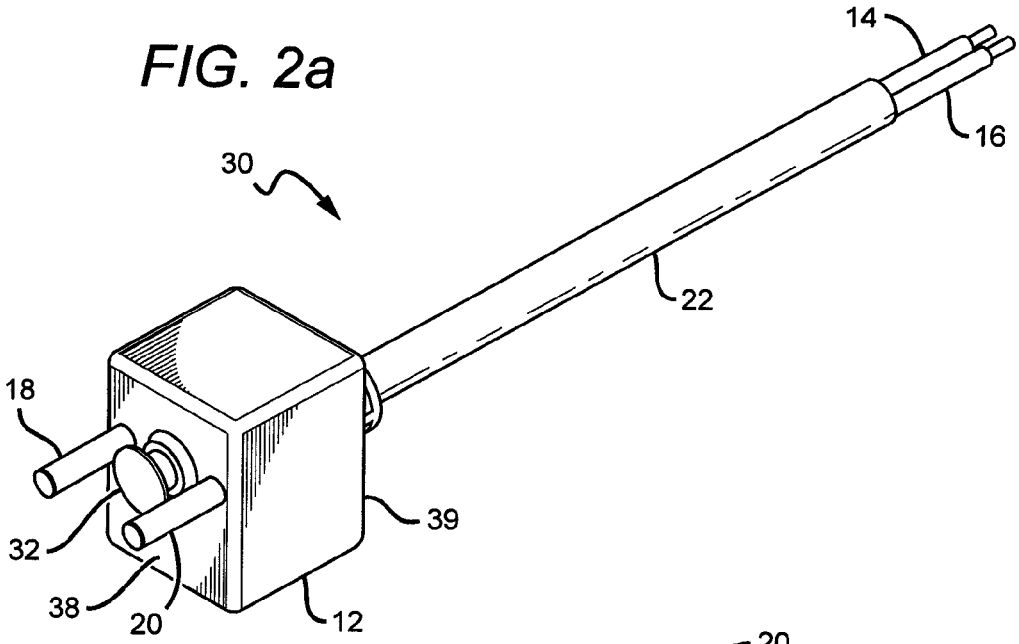
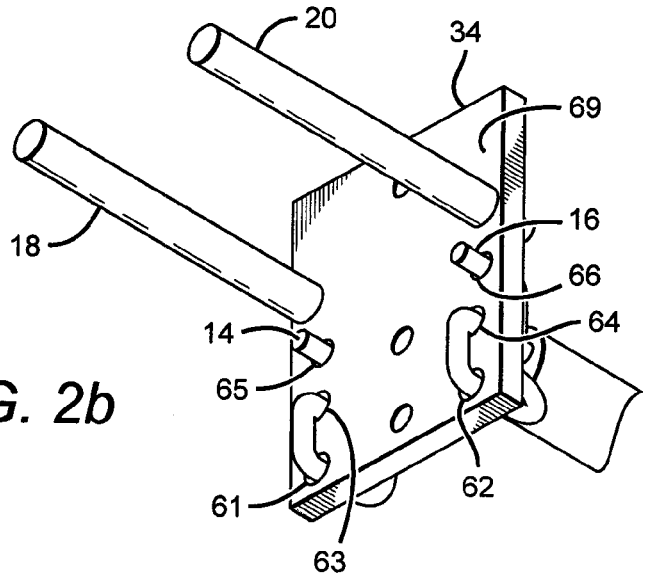
FIG. 2b
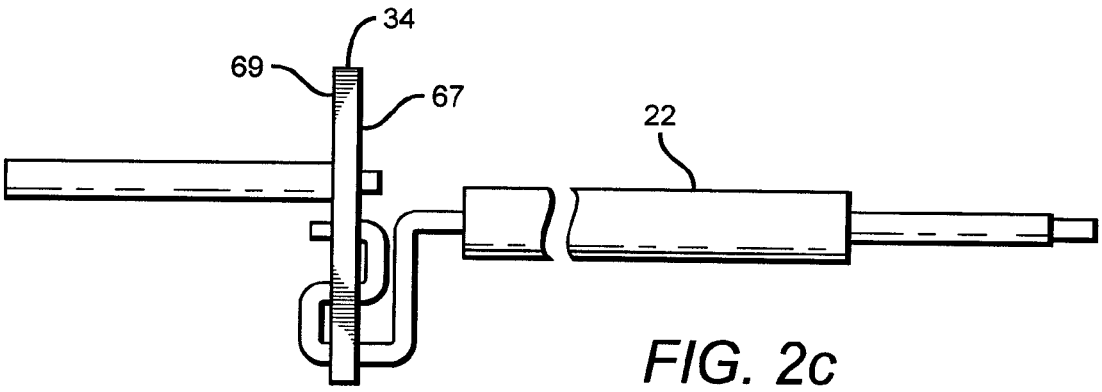
FIG. 2c

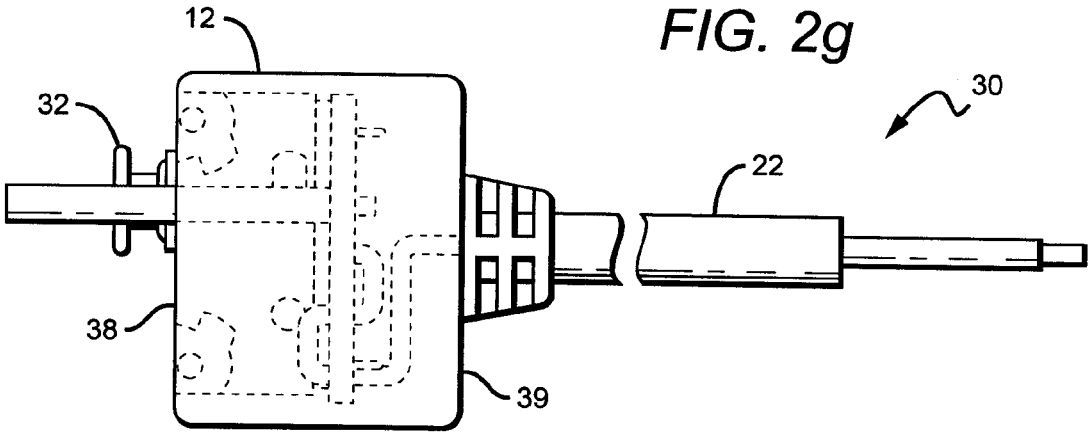
FIG. 2g
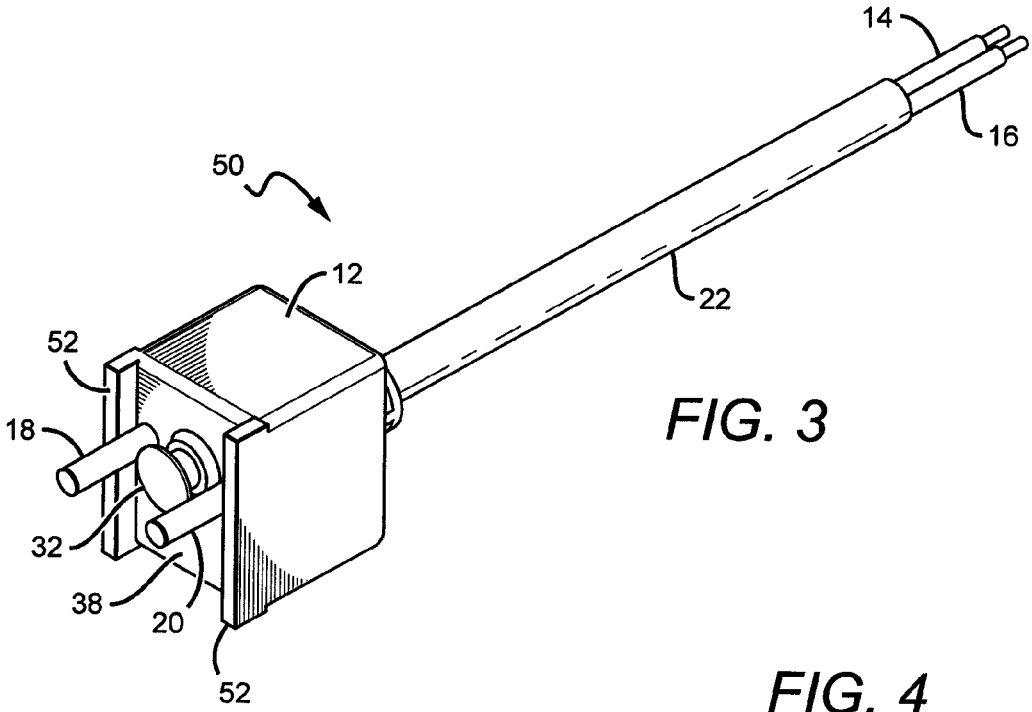
FIG. 3
FIG. 4
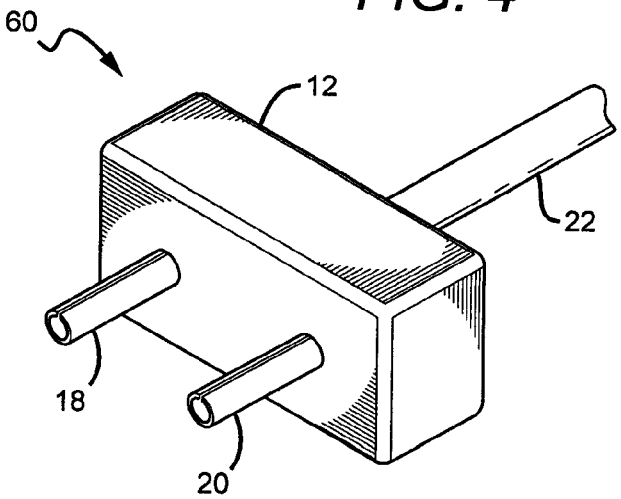

BI-PIN DONGLE

RELATED APPLICATIONS

This application claims the benefit of priority of U.S. Provisional Application Ser. No. 61/645,511, filed on May 10, 2012.

BACKGROUND OF THE INVENTION

1. Field of the Invention

This invention relates to a device to electrically connect luminaires through standard lamp holders to non-traditionally shaped lamps via a bi-pin connector on a cable.

2. Description of the Related Art

Bi-pin lamp fittings are common and have been utilized for over 100 years. A "bi-pin" or "bipin" lamp fitting can be described as two short parallel conductors used in conjunction with a lamp base to deliver power to a lamp or luminaire. The bi-pin lamp fitting designs, shapes, and sizes are generally defined by international code, specifically IEC 60061-1 and its subsections.

Sizes of lamp fittings are generally given identifying alphanumeric code in the format of GABCC.CC, where 'G' stands for "glass" and is a throwback to when all bulbs were made of glass. The letters 'A' and 'B' can be other various letters depending on the code and are defined per the IEC standard listed above. The 'C's are numbers and define the center-to-center spacing of the two pins and are normally given in millimeters. For example, G5 is a bi-pin connector with 5 mm pin spacing. G13 spacing is somewhat unique in that even though the pin spacing is 12.7 mm, or one half inch, the decimal is rounded up to the nearest integer.

Conventional lamp holders, of which there are various different types, are sufficient to support the weight of a lamp placed into it. This is accomplished primarily by compression on the bulb, spring and friction forces. For example, in small indicator lights, the friction caused by the contacts in the lamp holders (which tend to form springs) is sufficient to hold the light into place. Even in large lamps, the 8' fluorescent tubes such as T8 or T12, the lamp is held by both the spring loaded contacts in the lamp holders and also by applying a compression force on the lamp by the lamp holders' spacing and orientation.

The voltage polarity and type of current applied through the lamp holder is not specified. That is to say that some lamps connect with DC, and some connect with AC. Lamps, such as tubular fluorescents, can connect to the supply from two pairs of bi-pin contacts, with polarity on one set of pins being the same, and the opposite polarity being delivered on the second set of pins with current flowing through the gas in the bulbs. In certain circumstances, such as with instant start electronic ballasts, multiple line voltages can be delivered through one lamp holder (600VAC and 120VAC).

Lamp holders tend to dictate the size, location, and power consumption of the lamp, and as such, lamp sizes and shapes have become standardized, as well as locations of lamps has become somewhat standardized.

Financial incentives (through return on investment via reduced power consumption and its associated decreased energy cost, and from governmental subsidies) to upgrade incumbent lights and lighting systems to more efficient light emitting diode (LED) luminaires are creating opportunity to design new luminaires for certain applications.

The directivity of LEDs and the control of that light can often require optical elements to re-direct the light towards the illumination target since the lighting or luminance requirements of new systems are similar or identical to the incumbent systems. In retrofitting a fixture with LED lights, the luminous flux from the source irradiates in different intensity profiles from traditional lamps. The addition of an optic element in an application specific luminaire can add weight to a luminaire, and also can result in a non-traditional, non-uniform size and shape.

Unique luminaire designs with increased weight and unconventional shapes, along with a variety of retrofitting applications, require a method to deliver power to the luminaires without excessive re-wiring, re-working, or excessive time consumed during installation, maintenance, and operation. Finally, a unique connection and mounting solution may create unintended safety concerns, which need to be addressed as they arise.

SUMMARY

The invention disclosed herein provides various embodiments of bi-pin dongles that are cost effective, easy to install and deliver power to an electronic device, such as but not limited to a luminaire. The different embodiments comprise elements to electrically connect a luminaire through standard lamp holders to non-traditionally shaped lamps by way of a bi-pin connector on a cable. The bi-pin dongles can comprise many different materials or devices arranged in different ways, with some bi-pin dongles comprising safety measures to prevent injury during installation of the lamp or luminaire connected to the bi-pin connector.

In one embodiment, as broadly described herein, a bi-pin dongle comprises at least one conductive contact, first and second conductors electrically connected to the at least one conductive contact, and a housing. The at least one conductive contact can be U-shaped to form a first and a second parallel pin wherein the first conductor is electrically connected to the first pin and the second conductor is electrically connected to the second pin. A section of each of the first and second pins and the first and second conductors are housed within the housing such that a portion of the first and second pins extend outwards from said housing.

In another embodiment, a bi-pin dongle comprises a first and a second conductive pin on a printed circuit board (PCB), first and second conductors electrically connected to said PCB, and a housing, wherein the first conductive pin is electrically connected to the first conductor and the second conductive pin is electrically connected to the second conductor such that the first and second conductive pins are electrically isolated from each other. The housing comprises at least one extension adjacent the first and second conductive pins which is a safety device that is adapted to prevent electric shock. The housing further comprises a support structure opposite the first and second pins and about the first and second conductors, wherein the support structure provides structural support such that the bi-pin dongle can support the weight of an electrical device attached to the bi-pin dongle.

These and other aspects and advantages of the invention will become apparent from the following detailed description and the accompanying drawings which illustrate by way of example the features of the invention.

BRIEF DESCRIPTION OF THE DRAWINGS

FIG. 2*a* is a perspective view of an embodiment of a bi-pin dongle according to the invention;

FIG. 2*b* is a perspective view of the internal component of the bi-pin dongle of FIG. 2*a;*

FIG. 2*c* is a side view of the internal component of the bi-pin dongle of FIG. 2*a;*

FIG. 2*g* is a side view of the bi-pin dongle of FIG. 2*a;*

FIG. 3 is a perspective view of an embodiment of a bi-pin dongle according to the invention;

FIG. 4 is a perspective view of an embodiment of a bi-pin dongle according to the invention;

DETAILED DESCRIPTION

Figure 1A:
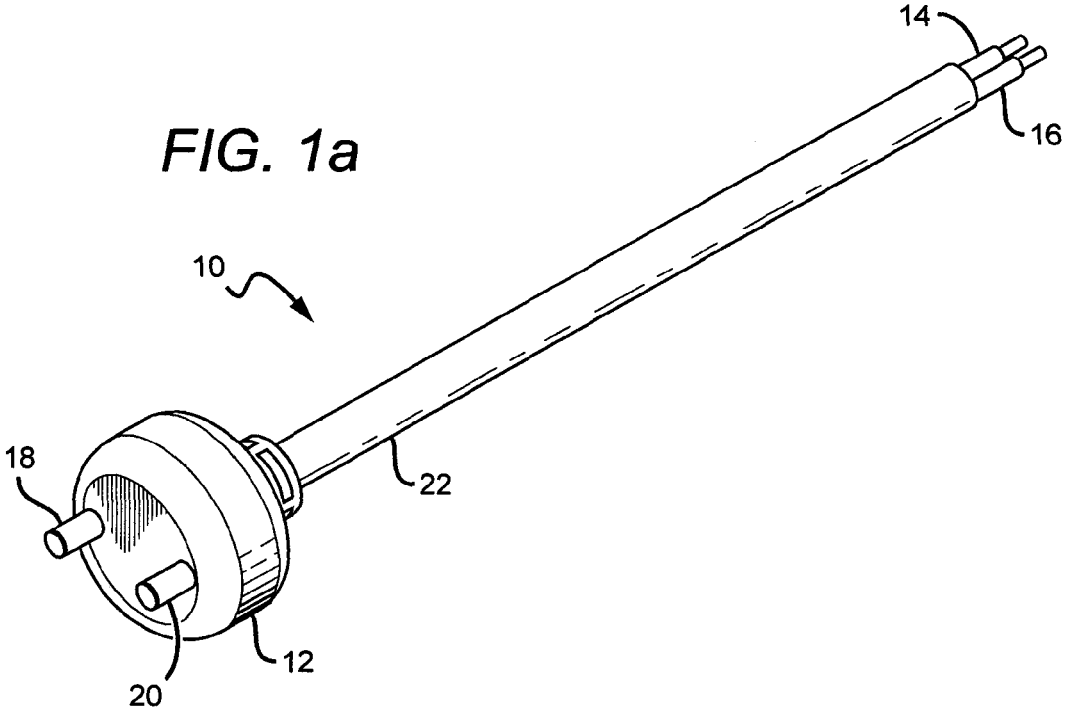
FIG. 1*a* is a perspective view of an embodiment of a bi-pin dongle according to the invention.

The invention described herein is directed to different embodiments of a bi-pin dongle that in some embodiments is adapted to be received by a standard lamp holder to provide an electrical signal to a non-conventionally shaped lamp or other electronic device. The bi-pin dongle can comprise many different materials and can be used to power many different electronic devices such as, but not limited to, a non-standard lamp or luminaire. The bi-pin dongle according to the present invention can be arranged in many different ways with many different components, and are generally arranged to provide a connection between a lamp or luminaire and a standard lamp holder such that an electrical signal can be supplied to the lamp or luminaire. In some embodiments, the bi-pin dongle can comprise at least one conductive contact, first and second conductors electrically connected to the conductive contact, and a housing wherein the at least one conductive contact and first and second conductors are housed within the housing. The at least one conductive contact can comprise first and second conductive pins that extend outwards from the housing and are configured to be received by a standard lamp holder such that an electric signal can be supplied to the electronic device attached to the bi-pin dongle. This arrangement allows for a non-standard lamp to be easily installed in a conventional lamp holder without having to substantially re-wire the conventional lamp holder in order to properly power the non-standard lamp. An advantage of the bi-pin dongle is that the non-standard lamp can be used that has a light emission that can be an improvement over conventional lamps used in conventional lamp holders. This allows for the directivity of the emitted light from non-standard lamps to be optimized or maintained.

The bi-pin dongle of the present invention can provide a number of additional advantages beyond those mentioned above. For example, the non-standard lamp could be configured to be pivotable such that the light emission can be adjusted to illuminate different areas. Another advantage of the invention is that a different light source, such as but not limited to light emitting diodes (LEDs), can be used instead of the conventional lamp (e.g. fluorescent tube, halogen light bulb, or metal halide lamp, etc.) which provides sufficient lighting at a reduced power level, thereby being energy efficient. Yet another advantage is that light emitting devices are not the only type of electronic devices that can be attached to the bi-pin dongle. The bi-pin dongle could be configured to provide an electrical signal to a variety of electronic devices, such as but not limited to home appliances, power tools and the like.

Some embodiments of the bi-pin dongle according to the invention can be used to provide power to a lamp or luminaire, such as those used to provide light in commercial or residential settings. However, the invention is not intended to be limited to such embodiments. As further described below, the bi-pin dongle can be arranged to allow an individual to easily install a non-standard lamp connected to the bi-pin dongle to a conventional lamp holder.

The invention is described herein with reference to certain embodiments, but it is understood that the invention can be embodied in many different forms and should not be construed as limited to the embodiments set forth herein. In particular, the present invention is described below in regards to certain lighting fixtures in different configurations, but it is understood that the invention can be used for many other devices having many different configurations. The components can have different shapes and sizes beyond those shown in the figures or discussed herein.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the device in addition to the orientation depicted in the figures.

Embodiments of the invention are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

Figure 1B:
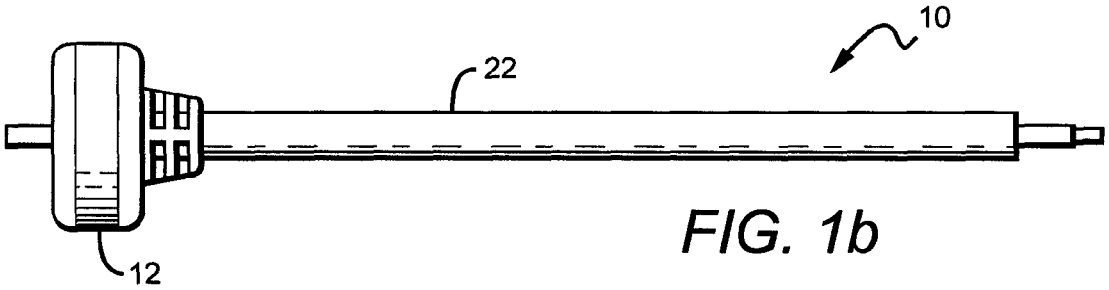
FIG. 1*b* is a side view of the bi-pin dongle of FIG. 1*a;*
Figure 1C:
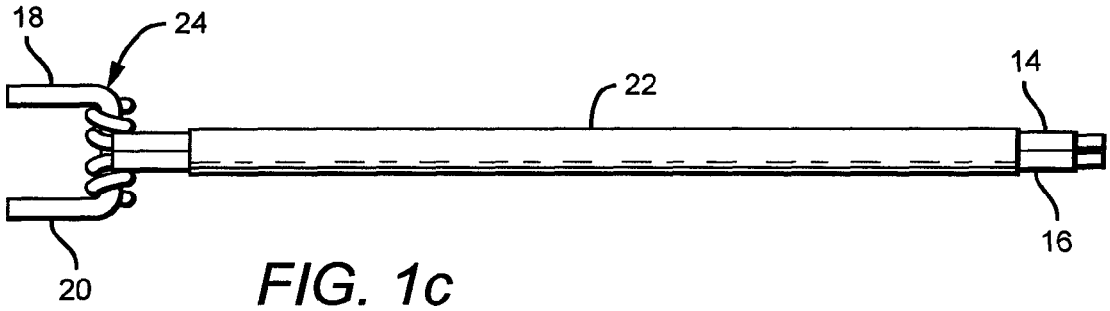
FIG. 1*c* is a side view of the internal components of the bi-pin dongle of FIG. 1*a;*

FIGS. 1*a*-1*c* show one embodiment of a bi-pin dongle 10 according to an embodiment of the invention. In some embodiments, the bi-pin dongle 10 is configured such that the bi-pin dongle 10 can be received by conventional bi-pin lamp holders or similar structures to provide an electric signal to a non-standard lamp that is attached to the bi-pin dongle 10. The bi-pin dongle 10 comprises at least one conductive contact 24, first and second conductors 14, 16 electrically connected to the at least one conductive contact 24, and a housing 12. The at least one conductive contact 24 can be U-shaped to form a first and a second conductive pin 18, 20 wherein the first conductor 14 is electrically connected to the first conductive pin 18 and the second conductor 16 is electrically connected to the second conductive pin 20. A section of each of the first and second pins 18, 20 and the first and second conductors 14, 16 are housed within the housing 12 such that the first and second pins 18, 20 are configured to extend outwards from said housing 12. The first and second conductors 14, 16 also extend outwards from the housing 12 and are adapted to be electrically connected to a lamp or electronic device. The first and second conductors 14, 16 are received by a sleeve which protects the conductors 14, 16 from damage. The sleeve 22 can also be adapted to provide structural support to the lamp connected to the bi-pin dongle 10.

In one embodiment, as shown in FIG. 1*c*, the conductive contact 24 is formed of a single solid body, such as but not limited to brass rod stock. However, in other embodiments, such as in FIG. 4, the conductive contact 24 is formed from sheet metal rolled or formed into a useful shape. The conductive contact 24 is formed in a U-shape configuration which forms the first and second conductive pins 18, 20. The conductive pins 18, 20 are configured to be parallel with respect to each other and also have the same dimensions. For example, the length of the conductive pins 18, 20 are substantially identical such that the conductive pins 18, 20 can be received by conventional lamp holders. However, in other embodiments, the conductive contact can be formed in many different shapes to accommodate different lamp holders or receptacles. In yet other embodiments, the conductive pins 18, 20 can be arranged to have different dimensions and/or varying lengths.

FIG. 1*c* shows the internal components of the bi-pin dongle 10. In the embodiment shown in FIG. 1*c*, the first and second conductors 14, 16 are connected directly to the conductive contact 24. The first and second conductors 14, 16 can be arranged such that they are coiled around the conductive contact 24. The first and second conductors 14, 16 being coiled around the conductive contact 24 assists in providing structural support to the lamp that is connected to the bi-pin dongle 10. The first and second conductors 14, 16 must be able to withstand strain caused by the lamp connected to the bi-pin dongle 10 such that the point at which the conductors 14, 16 are connected to the conductive contact 24 does not become compromised. In some embodiments, the first and second conductors are able to withstand a 5 pound pull test. However, the first and second conductors can be configured to withstand more than 5 pounds, and is not intended to be limited to be able to only withstand a 5 pound pull test. The first and second conductors 14, 16 can be electrically connected to the conductive contact 24 using various different methods and is not intended to be limited to the embodiments discussed herein.

The configuration of the first and second conductors 14, 16 and the conductive contact 24, as shown in FIGS. 1*a*-1*c*, are arranged such that the first and second conductive pins 18, 20 are in the same phase. The first and second conductive pins 18, 20 can also be configured to have the same polarity.

The housing 12, as shown in the embodiments of FIGS. 1*a* and 1*b*, can be an overmolded housing. The overmolded housing 12 can be formed of plastic, polyvinyl chloride (PVC) or any other material able to be overmolded. The housing 12 provides protection to the internal components of the bi-pin dongle 10, namely the point at which the conductors 14, 16 are connected to the conductive contact 24. The internal components of the bi-pin dongle 10 can also be covered by an encapsulant or other sealant, in addition to being within the overmolded housing 12, which further assists in protecting the internal components of the bi-pin dongle 10. The housing 12 in FIGS. 1*a* and 1*b*, is shown as having a circular shape, but the housing 12 is not intended to be limited to a circular shape. The housing 12 can be in the form of many different shapes, such as but not limited to, cubic, rectangular, or any other shape in accordance with a given application setting.

The sleeve 22, which receives the first and second conductors 14, 16, can also be made of the same material as the housing 12. In other embodiments, the sleeve 22 can be made of material that is different than the housing 12. In yet other embodiments, the sleeve 22 can be configured to assist in providing structural support. For example, the sleeve 22 can be made of a rigid material which provides structural support for the lamp connected to the bi-pin dongle 10, or can comprises structural support components that reduce the strain exerted by the lamp connected to the bi-pin dongle 10.

FIGS. 2*a*-2*g* show an embodiment of the bi-pin dongle 30 according to the invention, and disclose additional components or features that may be included in the bi-pin dongle 10. For the same or similar features, the same reference numbers will be used throughout the application herein. The bi-pin dongle 30 comprises first and second conductive pins 18, 20 mounted on a printed circuit board (PCB) 34, first and second conductors 14, 16 electrically connected to the PCB 34, and a housing 12. The PCB 34 has a plurality of holes specifically arranged on the PCB in order to receive the conductive pins 18, 20 and the conductors 14, 16. The first conductor 14 is electrically connected to the PCB 34 such that the first conductive pin 18 is electrically connected to the first conductor 14. The second conductor 16 is electrically connected to the PCB 34 such that the second conductive pin 20 is electrically connected to the second conductor 16. A section of each of the first and second pins 18, 20 and the first and second conductors 14, 16 are housed within the housing 12 such that the first and second pins 18, 20 are configured to extend out a first surface 38 of said housing 12, while the first and second conductors 14, 16 extend out a second surface 39 of the housing 12 opposite the first surface 38. The first and second conductors 18, 20 are received by a sleeve 22 and are adapted to be electrically connected to a lamp or electronic device. The sleeve 22 protects the conductors 14, 16 from damage and can also be adapted to provide structural support to the lamp connected to the bi-pin dongle 30.

Figure 6:
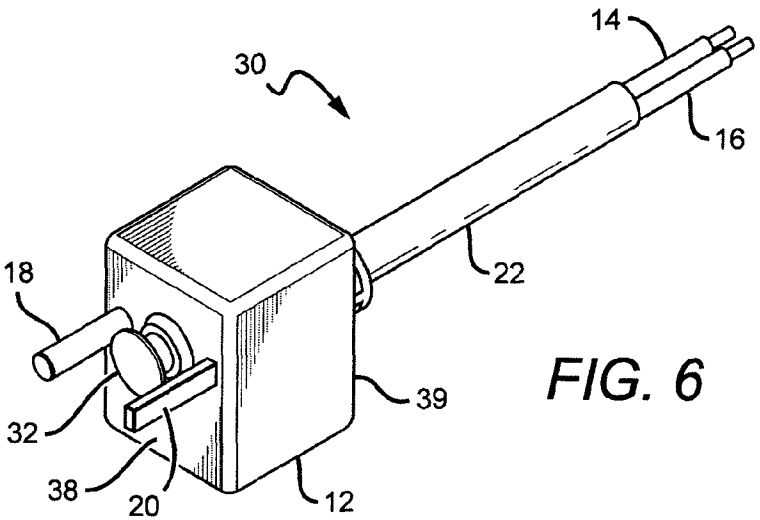
FIG. 6 is a perspective view of an embodiment of a bi-pin dongle according to the invention.

The first and second conductive pins 18, 20 of bi-pin dongle 30 are not formed from a single conductive contact, as disclosed above in the embodiment of bi-pin dongle 10. Instead, the first and second conductive pins 18, 20 of bi-pin dongle 30 are individual components that are individually mounted onto the PCB 34. The first and second conductive pins 18, 20 are mounted onto the PCB 34 such that they are parallel to each other and are perpendicular with respect to the PCB 34. In one embodiment, the first and second conductive pins 18, 20 are configured to have the same dimensions. For example, the length of the conductive pins 18, 20 are substantially identical such that the conductive pins 18, 20 can be received by conventional lamp holders. However, in other embodiments as shown in FIG. 6, the conductive pins 18, 20 can be formed in many different shapes to accommodate different lamp holders or receptacles. In yet other embodiments, the conductive pins 18, 20 can be arranged to have different dimensions and/or varying lengths. The first and second conductive pins 18, 20 can be formed of many different electrically conductive materials, such as but not limited to brass rod stock or tin plated brass.

Figure 2D:
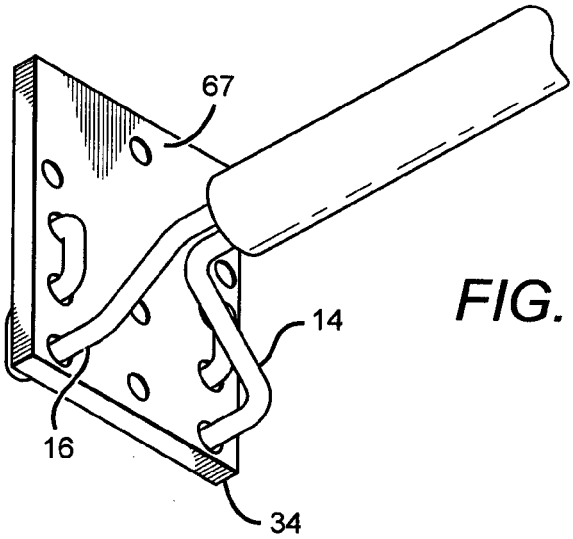
FIG. 2*d* is a perspective view of the internal component of the bi-pin dongle of FIG. 2*a;*

FIGS. 2*b*-2*d* show internal components of the bi-pin dongle 30. In the embodiment shown in FIGS. 2*b*-2*d*, the first and second conductors 14, 16 are threaded through a set of respective holes on the PCB 34 in a serpentine-like manner. In one embodiment, the first conductor 14 extends through a first surface 67 of PCB 34 via a first hole 61, through a second surface 69 of PCB 34 opposite the first surface 67 via a second hole 63, and through the first surface 67 of PCB 34 via a third hole 65. The first conductor 14 is electrically connected to the PCB 34 at hole 65. The second conductor 16 is threaded in a similar manner as first conductor 14. The second conductor 16 extends through a first surface 67 of PCB 34 via a first hole 62, through a second surface 69 of PCB 34 opposite the first surface 67 via a second hole 64, and through the first surface 67 of PCB 34 via a third hole 66. The second conductor 16 is electrically connected to the PCB 34 at hole 66. The first and second conductors 14, 16 can be threaded through the respective set of holes of the PCB 34 in many different ways and is not intended to be limited to the order of holes disclosed above. An advantage of the invention is that threading first and second conductors 14, 16 through the PCB 34 allows the first and second conductors 14, 16 to assist in providing structural support for the lamp attached to the bi-pin dongle 30. The bi-pin dongle 30 must be able to withstand the pulling force exerted by the attached lamp such that the electrical connection between the conductors 14, 16 and the PCB 34 is not destroyed. The PCB 34 in conjunction with the threaded conductors 14, 16 provide the necessary strain relief required to ensure the electrical connection between the conductors 14, 16 and the PCB 34 is not damaged. As discussed above, the conductors 14, 16 are configured to sustain a 5 pound pull test, but can also be configured to withstand more pulling force than 5 pounds.

The PCB 34 is configured to make an electrical connection between the first conductor 14 and the first conductive pin 18, and between the second conductor 16 and the second conductive pin 20. The PCB 34 is further configured to electrically isolate the first and second conductive pins 18, 20 from each other. The configuration of PCB 34 allows the first and second conductive pins 18, 20 to be out of phase and/or the potential levels between the conductive pins 18, 20 can be at different levels. This allows for a higher power level to be supplied to the lamp or electrical device attached to the bi-pin dongle 30.

In some embodiments of the invention, the bi-pin dongle 30 can be configured to have a safety device 36 that prevents electrical shock during installation or handling of the lamp. In one embodiment, the safety device 36 is a switch 36 having a push button actuator 32, wherein the push button actuator 32 is adapted to open or close the electrical circuit within the bi-pin dongle 30, thereby allowing or preventing electrical current to flow. When the bi-pin dongle 30 is not installed within a lamp holder or similar structure, the switch is configured to create an open circuit within the bi-pin dongle 30 thereby preventing current flow within the bi-pin dongle 30 and eliminates the potential for electric shock. When the bi-pin dongle 30 is installed in the lamp holder, the switch is configured to close the open circuit within the bi-pin dongle 30 and allows current to flow within the bi-pin dongle 30. In one embodiment, the lamp holder imparts a force on the push button actuator 32 which causes the switch 36 to close the open circuit upon the proper installation of the bi-pin dongle 30. While the bi-pin dongle 30 remains installed in the lamp holder, the lamp holder continues to impart a force on the push button actuator 32 which maintains the closed circuit and allows current to flow. Upon the removal of the bi-pin dongle 30 from the lamp holder, the lamp holder no longer imparts a force on the push button actuator 32 and the switch automatically creates an open circuit preventing current flow.

Figure 2E:
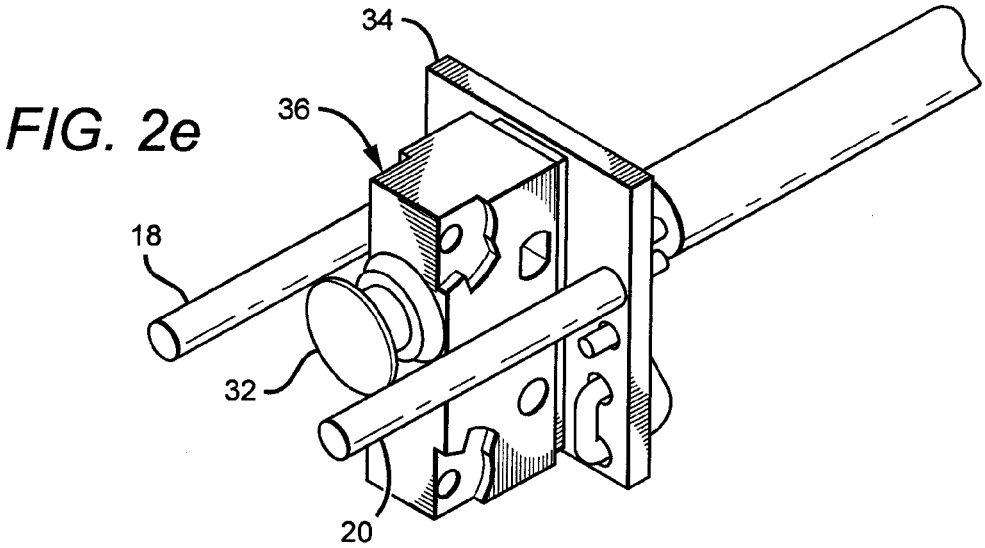
FIG. 2*e* is a perspective view of the internal component of the bi-pin dongle of FIG. 2*a;*
Figure 2F:
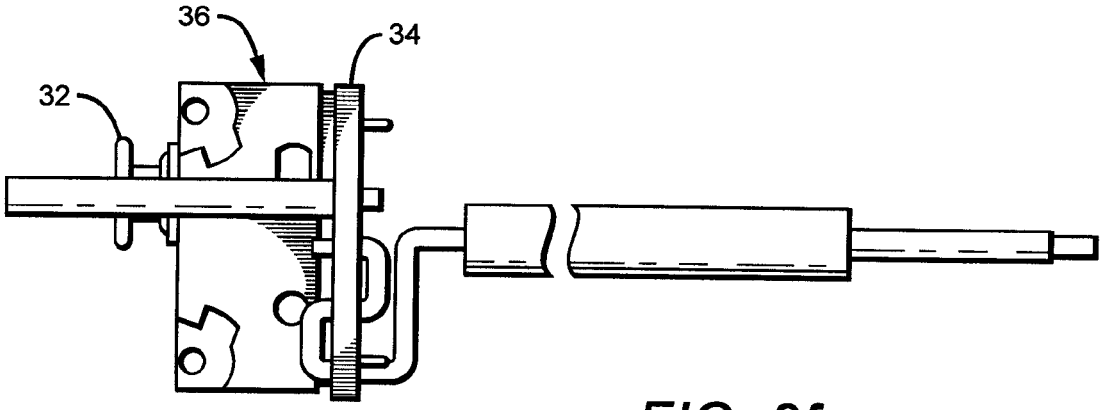
FIG. 2*f* a side view of the internal component of the bi-pin dongle of FIG. 2*a;*

In the embodiment shown in FIGS. 2*e* and 2*f*, the switch 36 is mounted on the second surface 69 of the PCB 34 adjacent the first and second conductive pins 18, 20. In other embodiments, the switch 36 can be positioned elsewhere on or within the bi-pin dongle 30 to prevent or allow current to flow.

The housing 12 and sleeve 22 of bi-pin dongle 30 have similar characteristics to the housing 12 and sleeve 22 of bi-pin dongle 10, discussed above. The housing 12, as shown in FIG. 2*a* has a cube-like shape, but can in the form of many different shapes. The first and second conductive pins 18, 20 extend outwards from the first surface 38 of the housing 12 and are spaced apart from each other to accommodate the switch 36, such that the switch 36 is mounted on the PCB 34 and in between the conductive pins 18, 20. The switch 36 is within the housing and the push button actuator 32 is configured to extend outward from the first surface 38 of the housing 12, similar to the first and second conductive pins 18, 20. However, as shown in FIGS. 2*f* and 2*g*, the push button actuator 32 does not extend out from the housing 12 as far as or beyond the conductive pins 18, 20.

The sleeve 22 can be made of the same material as the housing 12. In other embodiments, the sleeve 22 can be made of material that is different than the housing 12. In yet other embodiments, the sleeve 22 can be configured to assist in providing structural support. For example, the sleeve 22 can comprise a structural support component that reduces the strain exerted by the lamp connected to the bi-pin dongle 10. In one embodiment, the structural support component is a resilient rubber band-like loop that can be used to hold the bi-pin dongle 30 in solid contact with the lamp holder.

FIG. 3*a* shows an embodiment of a bi-pin dongle 50 that is similar to the bi-pin dongle 30. However, the bi-pin dongle 50 comprises an additional safety measure in the form of housing extensions 52. The housing extensions 52 extend from the first surface 38 of the housing 12 and are configured to prevent the first and second conductive pins 18, 20 from being contacted by a foreign object upon installation in a lamp holder. The bi-pin dongle 50 also has the switch 36 between the conductive pins 18, 20 and the push button actuator 32 extending from the housing 12, as discussed in the embodiment of bi-pin dongle 30.

Figure 5A:
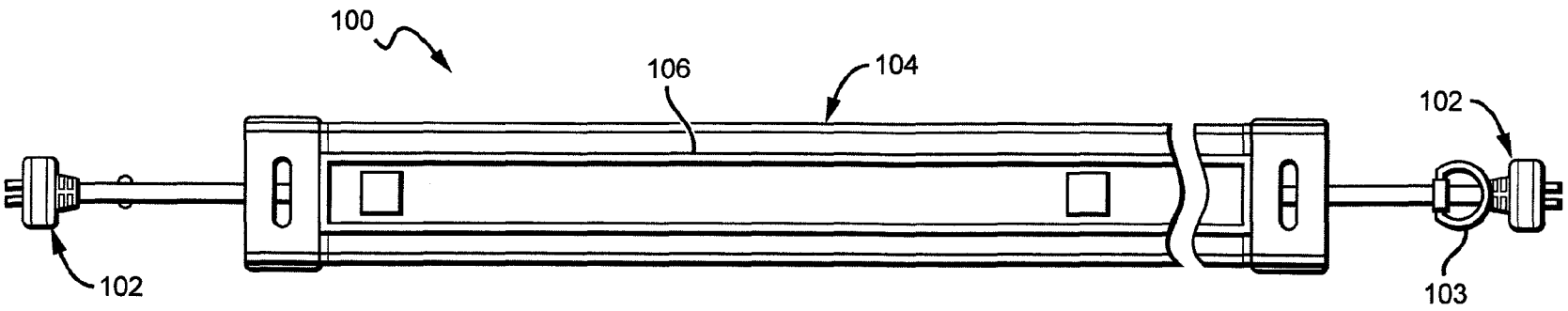
FIG. 5*a* is a perspective view of a lighting system according to an embodiment of the invention.
Figure 5B:
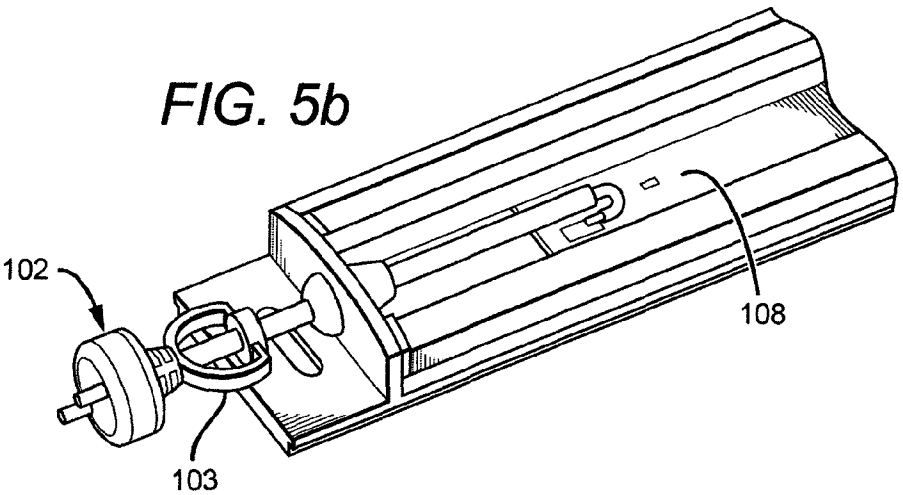
FIG. 5*b* is a perspective view of the lighting system of FIG. 5*a*.

FIG. 5*a*-5*b* show an embodiment of a lighting system 100 which comprises at least one bi-pin dongle 102 and a lamp 104. The bi-pin dongle 102 can be any of the bi-pin dongles 10, 30, 50, 60 discussed herein. However, for ease of simplicity, bi-pin dongle 10 having a resilient rubber band-like loop structural support component 103 is shown in FIG. 5*a*. The lamp 104 comprises a lamp housing 106 and a light source array 108 electrically connected to the at least one bi-pin dongle 102. The lighting system 100 is configured to be a retrofit kit unit that can be installed in existing conventional lamp holders. The lighting system 100 is also adapted to be mounted in many different settings, such as but not limited to commercial shelving display units. In some embodiments, the lamp housing 106 can be mounted using a screw, nut, nail or the like. In other embodiments, double sided adhesive tape can be used to mount the lighting system. In yet other embodiments, a plurality of magnets can be used to attach the lamp housing 106 to magnetically attractive materials. An advantage of the lighting system 100 is that the bi-pin dongle 102 allows for the lamp 104 to be located and installed away from the lamp holders. This means that if whatever shape or size of lamp the bi-pin dongle 102 is attached to, the lamp can be placed in a location where it will properly fit and not necessarily where the bulb it is replacing used to sit. This allows designers to create optimal lights for each retrofit application.

Yet another advantage of the lighting system 100 is that the lamp housing 106 and/or the at least one bi-pin dongle 102, upon installation, can be rotatable about an axis parallel to the conductors that attach the lamp 104 to the bi-pin dongles 102. This allows the directivity of the light emitted from the lighting system 100 to be adjusted as desired for any given application. This overcomes the potential problem of the lamp holder and the pin orientation. For example, if the bi-pin contacts of the lamp 104 are rigidly fixed to the lamp 104, then a rotation of 90 degrees can render the lamp 104 useless in certain circumstances. However, since the at least one bi-pin dongle 102 is configured to be rotatable after installed in the lamp holder, then any configuration or orientation of the lamp holder can be acceptable in any retrofit application.

Although the invention has been described in considerable detail with reference to certain configurations thereof, other versions are possible. Bi-pin dongles according to the invention can be many different sizes and can be used for many different applications. A separate power supply can be used for bi-pin dongle or conductive pins. In other embodiments, a variable power supply can be used to control the intensity of the lamp. The gage of the conductors and the length can be determined by the application based on current, voltage, and voltage drop over a given length. The bi-pin dangles can be used with AC or DC, for single or two-sided lamp/luminaire applications, and for any number of different lamp holders depending on the contact diameter, shape and length. Therefore, the spirit and scope of the invention should not be limited to the versions described above.

I claim:

1. A bi-pin dongle, comprising:

at least one conductive contact;

first and second conductors electrically connected to said at least one conductive contact;

a housing covering at least part of said at least one conductive contact and said conductors, wherein said at least one conductive contact is U-shaped and arranged to provide a first and second parallel pin, wherein said first and second parallel pins are adapted to be received by a standard lamp holder, wherein one or more conductors extend from said housing and adapted to be electrically connected to an electronic device such that an electrical signal can be supplied to said electronic device attached to said bi-pin dongle.

2. The bi-pin dongle of claim 1, wherein said first conductor is electrically connected to said first parallel pin and said second conductor is electrically connected to said second parallel pin.

3. The bi-pin dongle of claim 2, wherein part of said first and second parallel pins housed within said housing, such that a portion of said first and second parallel pins extend outwards from said housing.

4. The bi-pin dongle of claim 2, wherein said housing comprises a support structure opposite said first and second pins and about said first and second conductors, wherein said support structure provides structural support to withstand the weight of said electrical device attached to said bi-pin dongle.

5. The bi-pin dongle of claim 2, wherein said first and second parallel pins are in the same phase.

6. The bi-pin dongle of claim 1, wherein said first and second conductors are within a sleeve, wherein said sleeve is coupled to said housing and adapted to provide structural support.

7. The bi-pin dongle of claim 6, wherein said sleeve is formed of a rigid material to provide said structural support.

8. The bi-pin dongle of claim 1, wherein said at least one conductive contact is formed from rolled sheet metal.

9. The bi-pin dongle of claim 1, wherein said first and second parallel pins are similarly shaped.

10. The bi-pin dongle of claim 1, wherein said first and second parallel pins are shaped differently to accommodate various lamp holder or receptacles.

11. The bi-pin dongle of claim 1, wherein said electronic device is a non-standard lamp.

12. A bi-pin dongle, comprising:

first and second conductive pins on a printed circuit board (PCB);

first and second conductors electrically connected to said PCB;

said PCB comprising a plurality of holes arranged on the PCB to receive said pins and said conductors; and a housing covering at least part of said first and second pins and said first and second conductors, wherein said first and second pins configured to extend out a first surface of said housing and said first and second conductors configured to extend out a second surface of said housing opposite said first surface.

13. The bi-pin dongle of claim 12, wherein said first conductive pin is electrically connected to said first conductor and said second conductive pin is electrically connected to said second conductor such that said first and second conductive pins are electrically isolated from each other.

14. The bi-pin dongle of claim 12, said housing comprising at least one extension adjacent said first and second conductive pins.

15. The bi-pin dongle of claim 14, wherein said at least one extension is a safety device and adapted to prevent electric shock.

16. The bi-pin dongle of claim 15, wherein said safety device comprises a switch having a push button actuator, wherein said push button actuator is adapted to open or close an electrical circuit within said bi-pin dongle, such that when said push button actuator is depressed said switch closes said electrical circuit and is arranged to allow current to flow through said electrical circuit.

17. The bi-pin dongle of claim 16, wherein said switch is mounted on said PCB adjacent said first and second conductive pins and housed within said housing, said push button actuator configured to extend outward from said housing adjacent said first and second conductive pins.

18. The bi-pin dongle of claim 12, wherein said first and second conductors adapted to be received by conventional lamp holders.

19. The bi-pin dongle of claim 12, wherein said first and second conductors are threaded through said PCB in a serpentine-like manner.

20. The bi-pin dongle of claim 19, wherein said first conductor extends through a first surface of said PCB through a first hole, then through a second surface opposite said first surface of said PCB through a second hole, and then through said first surface through a third hole, wherein said first conductor is electrically connected to said PCB at said third hole.

21. The bi-pin dongle of claim 19, wherein said second conductor extends through a first surface of said PCB through a first hole, then through a second surface opposite said first surface of said PCB through a second hole, and then through said first surface through a third hole, wherein said second conductor is electrically connected to said PCB at said third hole.

22. The bi-pin dongle of claim 19, wherein said threaded first and second conductors are adapted to provide structural support for a device attached to said bi-pin dongle.

23. The bi-pin dongle of claim 19, wherein said bi-pin dongle adapted to withstand at least a 5 pound pull test.

24. A lighting system, comprising:

at least one bi-pin dongle comprising at least one conductive contact, first and second conductors electrically connected to said at least one conductive contact, and a housing covering at least part of said at least one conductive contact, wherein said at least one conductive contact is U-shaped and arranged to provide a first and second parallel pin; and a lamp comprising a lamp housing and a light source array electrically connected to said at least one bi-pin dongle;

wherein one or more conductors extend from said housing of said at least one bi-pin dongle and extend into said lamp housing of said lamp.

25. The lighting system of claim 24, wherein said at least one bi-pin dongle adapted to be received by a standard lamp holder such that an electrical signal can be supplied to said lamp.

26. The bi-pin dongle of claim 25, wherein said at least conductive contact arranged to provide a first and second parallel pin, wherein said first conductor is electrically connected to said first parallel pin and said second conductor is electrically connected to said second parallel pin.

27. The lighting system of claim 24, wherein at least one of said at least one bi-pin dongle and said lamp housing adapted to be rotated in order to adjust the directivity of light emitted from said lamp.

28. The lighting system of claim 27, wherein said at least one bi-pin dongle is adapted to be rotated about said first and second conductors.

29. The lighting system of claim 27, wherein said lamp housing is adapted to be rotated about said first and second conductors.

* * * * *